United States Patent [19]

Dünisch

[11] Patent Number: 4,690,652

[45] Date of Patent: Sep. 1, 1987

[54] METHOD OF MAKING A WALL STABILIZED INFRARED FLASH TUBE

[75] Inventor: Ingo Dünisch, Wiesbaden, Fed. Rep. of Germany

[73] Assignee: Heimann GmbH, Fed. Rep. of Germany

[21] Appl. No.: 713,405

[22] PCT Filed: Aug. 12, 1983

[86] PCT No.: PCT/DE83/00138

§ 371 Date: Mar. 4, 1985

§ 102(e) Date: Mar. 4, 1985

[87] PCT Pub. No.: WO85/00927

PCT Pub. Date: Feb. 28, 1985

[51] Int. Cl.[4] ..... H01J 9/32; H01J 9/36; H01J 61/36; H01J 61/06

[52] U.S. Cl. ..... 445/28; 313/623; 313/634; 313/632; 445/29

[58] Field of Search ..... 313/594, 573, 576, 612, 313/634, 623, 643, 632, 631; 445/29, 28, 26

[56] References Cited

U.S. PATENT DOCUMENTS

| | | | |
|---|---|---|---|
| 3,105,917 | 10/1963 | Van den Broek | 313/594 X |
| 3,230,028 | 1/1966 | Kayatt | 313/623 X |
| 3,593,056 | 7/1971 | Degawa et al. | 313/623 |
| 4,097,762 | 6/1978 | Hilton et al. | 313/594 X |

FOREIGN PATENT DOCUMENTS

| | | | |
|---|---|---|---|
| 144144 | 11/1951 | Australia | 313/573 |
| 0124942 | 9/1980 | Japan | 313/612 |
| 0204467 | 11/1983 | Japan | 313/643 |
| 0081855 | 5/1984 | Japan | 313/573 |

*Primary Examiner*—Palmer C. DeMeo

*Attorney, Agent, or Firm*—Hill, Van Santen, Steadman & Simpson

[57] ABSTRACT

A wall-stabilized infared flash tube has a glass bulb with a flash chamber therein with a cathode lead having an electrode member welded thereto inserted in the flash chamber, the flash chamber, the lead, and the electrode member having dimensions selected for minimizing the influences of white light on the output of the flash tube, so as to enhance the spectrum of the infared output. The flash chamber preferably has a length no longer than 20 mm, and an interior diameter in the range of approximately 0.6 mm to approximately 1.3 mm. A method for manufacturing such a flash tube includes the steps of welding the electrode member to the lead at one location, inserting the lead and electrode combination into a flash chamber of a glass bulb having suitable dimensions, and fusing the lead vacuum-tight to the glass bulb.

1 Claim, 1 Drawing Figure

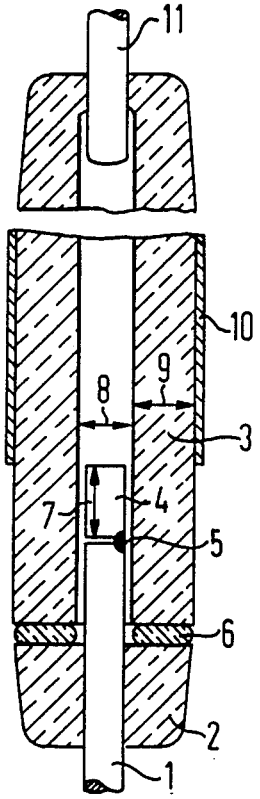
11
10
9
8
3
7
4
5
6
2
1

METHOD OF MAKING A WALL STABILIZED INFRARED FLASH TUBE

BACKGROUND OF THE INVENTION

1. Field of the Invention

The present invention relates to a wall-stabilized infrared flash tube having a lead fused inside a glass vacuum tube, and in particular to such a flash tube wherein the interior flash chamber of the tube has dimensions selected to minimize the influence of white light on the tube output.

2. Description of the Prior Art

Flash tubes are known in the art wherein, for a high light yield, the glass bulb has an inside diameter of, for example, only 1 mm and the filling pressure for the inert gas in the interior of the bulb is set to relatively high values of at least 1.3 Pa. Due to the pressure increase and the reduction of the cross-section, the component of visible light in the radiation emitted by the tube is increased and accordingly the specific frequency spectrum of the excited inert gas is marked and attenuated by a high component of white radiation.

SUMMARY OF THE INVENTION

It is an object of the present application to increase the efficiency of a wall-stabilized infrared flash tube by suitably selecting the interior dimensions of the flash chamber, and to provide a method for manufacturing such a flash tube.

The flash chamber in the flash tube disclosed herein has a length of approximately 20 mm and an interior dimension in the range of approximately 0.6 mm to approximately 1.3 mm.

Contary to expectations, no increase in the white radiation component occurs in infrared flash tubes due to such a reduction of the inside diameter of the glass bulb; to the contrary, the intensity of the spectral lines of the excited gas intensified, particularly in the infrared range. Xenon is preferably employed as the inert gas.

The infrared yield again noticeably decreases below the above lower limit for the inside diameter of the glass bulb. This effect is probably due to cooling of the gas by the glass bulb. At the same time, the glass bulb is heated to such degree by the discharge concentrated in a very tight space that, at least given the employment of the standard glass types for such glass bulbs, a considerable region of its inside surface is fused and decomposed, so that decomposition products precipitate on the cathode and render it ineffective ("poisoning"). In comparison thereto, a tube constructed in accord with the invention achieves an increase of from 30% to 50% in the yield of infrared radiation in comparison to commercially available tubes having an interior diameter of 1.9 mm when excitation pulses having the same energy are employed.

Given such tubes, the energy of the excitation pulses should lie between about 1J and 2J. The emission of visible light should be optimally low. This object is achieved in an especially advantageous fashion in an embodiment wherein the cathode lead has the largest possible outside diameter within the framework of allowable mechanical tolerances, wherein the outside diameter of an electrode member connected to the lead is not greater than that of the lead, and wherein the electrode member is secured to the lead by means of laser or electron welding. As a result of this embodiment, the dead space in the region next to and behind the electrode member is kept small. A further boost in the yield of infrared radiation and, thus, in the efficiency of the conversion of electrical energy into infrared radiation is thereby achieved.

An embodiment having an outer electrode as the trigger or control electrode is advantageous, whereby the wall thickness of the glass bulb is not greater than its inside diameter. Given this embodiment, the capacitive coupling of the standard trigger voltages of roughly 3 kV through 4 kV suffices in order to effect a sure ignition of the tube.

Such tubes are advantageously manufactured by a method wherein a cylindrical electrode member having a cylinder height of at least 1.2 mm which is coated and/or saturated with an activator is held at its generated surface and is welded to the cathode lead by means of a laser and the lead is then fused vacuum-tight into the glass bulb. The cylinder height of the electrode member of at least 1.2 mm enables grasping of the electrode member without too much heat being dissipated. The production of a faultless weld or welded seam is thus possible.

Beam welding, such as electron or laser welding, produces a clean, non-coating welded seam and also enables the cross-section of the weld to be kept small in comparison to the wire cross-section due to its high stability. As a result thereof, the heat transmission from the lead to the electrode member is diminished; heating during the fusing operation does not lead to an evaporation of the activator from the electrode member. This is important because an activator evaporated from the electrode member could have a considerable disruptive effect on the discharge as an electrically conductive deposit on the inside wall of the glass bulb.

Due to the high yield of infrared energy, the flash tube disclosed herein enables efficient range finders or remote controls to be produced with optimally low circuit outlay and energy consumption.

The invention shall now be explained in greater detail with reference to a FIGURE. It is not limited to the example shown in the FIGURE.

DESCRIPTION OF THE DRAWING

The single FIGURE is a shortened sectional view of a flash tube constructed in accordance with the principles of the present invention.

DESCRIPTION OF THE PREFERRED EMBODIMENTS

The FIGURE shows an infrared flash tube constructed in accordance with the principles of the present invention in a partially broken and cut view. A cathode lead 1 is fused into a glass ring 2. In this condition before being fused to the glass bulb 3, the electrode member 4 is connected mechanically and electrically to the lead 1 by means of a laser welding at only one weld location 5. During subsequent generation of a fused connection 6 between the bulb 3 and the ring 2, there is only slight heat conduction from the lead 1 via the weld location 5 to the electrode member 4. As a consequence, evaporation of the activator out of the electrode member 4 is suppressed.

The electrode member 4 has a cylinder length 7 of at least 1.2 mm. As a result thereof, the electrode member 4 can be held when being welded to the lead 1 without too much heat being dissipated.

The glass bulb 3 has a flash chamber with an inside diameter 8 which roughly corresponds to the wall thickness 9 of the glass bulb. The glass bulb 3 is surrounded by a trigger or control electrode 10 which is preferably an electrically conductive layer that is transmissive for infrared radiation.

The inside diameter 8 is in the range of approximately 0.6 mm to approximately 1.3 mm.

Given an inside diameter 8 of, for example, 1.0 mm, the diameter of the lead 1 and the diameter of the electrode member 4 preferably amount to 0.8 mm. The manufacturing tolerances can thereby be accommodated without difficulty.

An anode 11 extends at the other end of the glass bulb 3 into the interior thereof and likewise fills this out except for the required manufacturing tolerances. A back space is thereby also avoided in the region of the anode.

Instead of the straight embodiment as illustrated, the flash tube disclosed herein can also be curved, for example, U-shaped embodiment of an infrared flash tube.

I claim:

1. A method for manufacturing a wall-stabilized infrared flash tube comprising the steps of: holding a cylindrical electrode member having a cylinder length of at least 1.2 mm which is coated and/or saturated with an activator at its electron generating surface, securing said electrode member to a lead by beam welding by generating a weld having a cross-section less than the cross-section of the lead, inserting the electrode member on said lead into a flash chamber of a glass bulb, and fusing said lead vacuum-tight to the glass bulb.

* * * * *